United States Patent [19]

Kumar

[11] 4,287,740

[45] Sep. 8, 1981

[54] METHOD OF INCREASING THE FATIGUE LIFE OF TITANIUM ALLOY PARTS

[75] Inventor: Arun Kumar, Los Angeles, Calif.

[73] Assignee: Rockwell International Corporation, El Segundo, Calif.

[21] Appl. No.: 941,703

[22] Filed: Sep. 12, 1978

[51] Int. Cl.[3] ..... B24C 1/10; B22F 1/18; B21C 43/00

[52] U.S. Cl. ..... 72/40; 72/53

[58] Field of Search ..... 51/319, 320, 323, 324; 72/40, 53; 29/DIG. 36

[56] References Cited

U.S. PATENT DOCUMENTS

| | | | |
|---|---|---|---|
| 1,947,927 | 2/1934 | Vorwerk | 29/DIG. 36 |
| 2,055,220 | 9/1936 | Pine | 51/323 |
| 2,351,726 | 6/1944 | Wallace | 29/DIG. 36 |
| 3,073,022 | 1/1963 | Bush et al. | 72/53 |
| 3,188,776 | 6/1965 | Dill | 51/320 |
| 3,357,458 | 12/1967 | Radd et al. | 72/53 X |
| 3,410,124 | 11/1968 | Suwa | 72/53 |

*Primary Examiner*—Ervin M. Combs

*Attorney, Agent, or Firm*—Charles T. Silberberg

[57] ABSTRACT

A method of increasing the fatigue life of a metal part of a titanium alloy by subjecting it to the steps of abrasive cleaning and shot peening.

8 Claims, No Drawings

METHOD OF INCREASING THE FATIGUE LIFE OF TITANIUM ALLOY PARTS

BACKGROUND OF THE INVENTION

This invention relates to titanium alloy parts which are subjected to high surface stresses in use. More specifically, this invention relates to a method of treatment of such parts during their manufacture which will have the result of increased fatigue life. The invention is useful in the manufacture of titanium alloy parts in which high stresses are developed in and adj .cent to the surface. Typical parts and devices which develop such high surface stresses in use are connecting rods, springs and spring devices, spring wire, torque rods, drive shafts, and the like. Such parts are increasingly being manufactured from titanium alloys because of the weight savings.

During the manufacturing of titanium alloy springs, such parts are subjected to aging or other heat treatment. Due to the reactive nature of titanium alloys, such treatments result in surface oxidation. In the present state of the art, the titanium parts are subjected to a nitric acid pickling process to descale the oxidation products. However, it has been found that the acid pickling process is detrimental to the part surface conditions as it preferentially attacks the alpha particles at the grain boundaries in beta-titanium alloys, such as Ti-13V-11Cr-3Al and Ti-8Mo-8V-2Fv-3Al. The attacked grain boundaries act as notches and fatigue cracks initiate at these sites. Also, during the pickling process, hydrogen is picked up, which causes hydrogen embrittlement or hydride formation in certain titanium alloys.

PRIOR ART STATEMENT

U.S. Pat. No. 3,516,874 to Maker, et al., discloses a method for increasing the fatigue life of the metal part by subjecting it to the steps of electrolytic polishing and shot peening. Electrolytic polishing consists essentially in the removal of the exterior striae by immersing the part in a suitable electrolytic bath in which the part constitutes the anode. This is substantially different from abrasive cleaning where the part surface is blasted with abrasive particles of a specified size and material at a predetermined blast pressure. Further, it has been found that the patented process is not suitable for titanium alloy parts since hydrogen is picked up (which causes hydrogen-embrittlement) and there is a preferential attack or dissolution of alpha-phase in betatitanium alloys. Further, there is a tendency for titanium alloys to anodize during electropolishing. These problems are overcome with the present abrasive cleaning technique which also produces a compressive stress state at the surface which considerably increases the fatigue crack nucleation time. Other advantages over electropolishing are that the present technique is simpler, cheaper, and avoids the part size constraints required by use of an electropolishing tank.

SUMMARY OF THE INVENTION

It is, therefore, an object of the present invention to provide a method of improving the fatigue life of titanium alloy parts.

It is another object of this invention to provide a method of improving the fatigue life of titanium alloy parts which substantially eliminates the problems of hydrogen embrittlement and preferential attack on alpha phase in beta titanium alloys.

It is yet another object of the present invention to provide a method of improving the fatigue life of titanium alloy parts which is simple, economical, and not subject to significant part size constraints.

Briefly, in accordance with the invention, there is provided a method for increasing the fatigue life of parts made of a titanium alloy wherein the part is subjected to the steps of abrasive cleaning and shot peening.

In the preferred embodiment, the surface of the titanium alloy part is blasted with particles having a diameter within the range of about 0.0024 to 0.0082 inches at a blast pressure within the range of about 10 to 50 psi in the step of abrasive cleaning.

Other objects and advantages of the invention will become apparent upon reading the following detailed description.

DETAILED DESCRIPTION OF THE INVENTION

In manufacturing titanium alloy parts, such as coil springs, to which this invention is particularly concerned, oxidation products are produced on the surface of the part during the aging or other heat treatment thereof. The heat treating step is performed to improve the mechanical properties of the part. Conventionally, a nitric acid pickling process is performed to descale the oxidation products from the spring surface. However, this is detrimental to the spring surface conditions as previously described. The problems of the pickling process are over come by the present invention by combining abrasive cleaning and shot peening. While the present process can be used on any titanium alloy parts which are subject to continual high surface stresses, it has been found to be particularly advantageous for coil springs.

The abrasive cleaning to be used in the present process utilizes particles having a diameter within the range 0.0024 to 0.0082 inches. The preferred diameter size of particles, however, is about 0.0041 inches. These figures correspond to a Tyler standard screen mesh range of 250 to 65 with the preferred mesh size being 150. The abrasive particles can be of any standard type whose size can be controlled. However, it has been found that aluminum oxide grit yields very efficient results. The abrasive particles are blasted on the spring or other part surface with a blasting gun utilizing a blast pressure at the surface of the spring of 10 to 50 psi. The preferred pressure is about 30 psi. The size of the particles for abrasive cleaning is important because a smaller size will not have enough impact energy and a larger size will cause a surface imperfection. Blast pressure to be used in the abrasive cleaning step of the process must be within this range for similar reasons as above. Abrasive cleaning is to be distinguished from shot peening by virtue of the particle size and impact pressure used. In addition to descaling the oxidation products from the heat treated coil springs, without introducing hydrogen to cause hydrogen embrittlement, or preferentially attacking alpha phase in beta titanium alloys, such as Ti-13V-11Cr-3Al, it has been found that the abrasive cleaning of the present invention also introduces compressive stresses at the spring surface which improves fatigue strength. The time of application of the abrasive cleaning is normally approximately twenty minutes. This time is dependent upon obtaining 100% complete surface coverage. Shot peening alone would not be a satisfactory technique for descaling because of the large shot size and higher impact pressure, which would cause the oxide scale to be embedded at the surface of the part, subsequently generating surface flaws.

After the step of abrasive cleaning, the titanium alloy spring is preferably cleaned with a suitable alkaline cleaning solution. The purpose of this is to neutralize the acid used for cleaning the part prior to penetrant inspection for surface flaws and to clean the surface. Such cleaning is normally performed by immersing the part in an alkaline solution and then rinsing it off with deionized water. A solution found to be excellent in performing this cleaning step contains per gallon of solution 4 to 8 ounces sodium hydroxide, with the balance of the material high purity deionized water.

Shot peening is a well known procedure where the striae at and adjacent to the surface are compressed with beneficial result of cold working on the fatigue life of the part. The compressive residual stress of the surface area in which the highest stresses are developed in use is increased by such cold working to produce surface compression. For use in the present process, it has been determined that the spring should be shot peened with particles of corrosion resistant steel having a diameter in the range of about 0.017 to 0.039 inches using 100–200 percent surface coverage with an Almen intensity of 0.010 to 0.030 with an application time of thirty minutes. Preferably, the diameter used is about 0.028 inch at 0.018 Almen intensity with two hundred percent surface coverage. Shot peening is necessary after the step of abrasive cleaning to obtain a sufficiently flat surface and minimize grain separation in order to obtain the optimal increased fatigue life of the present invention. The size and intensity of the shot peening should be in the above noted ranges because smaller size with less intensity will not provide sufficient compressive stresses at the surface, while large size shot with high intensity will cause surface metal smear.

The beneficial results of the practice of the invention on coil springs formed of Ti-13V-11Cr-3Al alloys are shown by the results of tests summarized in the following tables.

TABLE I

| Condition | Cycles for Initiation of Fatigue Crack at Surface | Cycles at Failure |
|---|---|---|
| Pickling process | 0 | 2,661 |
| Pickling + shot peening (100% surface coverage) | 7,469 | 11,469 |
| Abrasive cleaning + shot peening (200% | >12,000 (no fatigue | 12,000* |

TABLE I-continued

| Condition | Cycles for Initiation of Fatigue Crack at Surface | Cycles at Failure |
|---|---|---|
| surface coverage | cracks observed) | (no failure) |

*Lifetime requirement

These results represent tests on a 0.048 inch diameter Ti-13V-11Cr-3Al alloy coil spring during a compression test from 17 to 3.87 inches at four cycles per minute. As can be seen, the percentage increase in cycles for fatigue crack initiation at the surface for the coil spring with abrasive cleaning followed by shot peening with 200% surface coverage over the present state of the art of pickling followed by shot peening with 100% surface coverage is at least sixty-one percent.

Thus, it is apparent that there has been provided, in accordance with the invention, a method for improving fatigue life of titanium alloy parts that fully satisfies the objectives, aims, and advantages, as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations which fall within the spirit and scope of the appended claims.

What is claimed is:

1. A method of increasing the fatigue life of a part made of titanium alloy, which comprises subjecting the part to the steps of first abrasive cleaning and thereafter shot peening, said abrasive cleaning comprising blasting the surface of said part with particles having a diameter within the range of about 0.0024 to 0.0082 inches at a blast pressure within the range of about 10 to 50 p.s.i., said step of shot peening using a higher intensity and larger particle size than said step of abrasive cleaning.

2. The method of claim 1 wherein said blast pressure is approximately 30 psi and said particles have a diameter of approximately 0.0041 inch.

3. The method of claim 2 wherein said particles are of aluminum oxide grit.

4. The method of claim 5 also including the step of alkaline cleaning after the step of abrasive cleaning and before the step of shot-peening.

5. The method of claim 4 wherein said shot peening is with shot having a diameter in the range of about 0.017 to 0.039 inches, with Almen intensity in the range of about 0.010 to 0.030, and with 100 to 200% surface coverage.

6. The method of claim 5 wherein said surface coverage is 200%, and said titanium alloy is a beta-titanium alloy.

7. The method of claim 6 wherein said shot is of corrosion resistant steel.

8. The method of claim 1 wherein said shot peening is with shot having a diameter in the range of about 0.017 to 0.039 inches, with Almen intensity in the range of about 0.010 to 0.030, and with 100 to 200% surface coverage.

* * * * *

UNITED STATES PATENT AND TRADEMARK OFFICE

CERTIFICATE OF CORRECTION

PATENT NO. : 4,287,740

DATED : September 8, 1981

INVENTOR(S) : Arun Kumar

It is certified that error appears in the above-identified patent and that said Letters Patent are hereby corrected as shown below:

Claim 4, line 1, delete "5" and substitute therefor ---3---.

Signed and Sealed this

*Third* Day of *November 1981*

[SEAL]

*Attest:*

GERALD J. MOSSINGHOFF

*Attesting Officer*

*Commissioner of Patents and Trademarks*